US009049765B1

(12) United States Patent
Powell et al.

(10) Patent No.: US 9,049,765 B1
(45) Date of Patent: Jun. 2, 2015

(54) SYSTEMS AND METHODS FOR CONVERTING ALTERNATING CURRENT TO DRIVE LIGHT-EMITTING DIODES

(71) Applicant: Colorado Energy Research Technologies, LLC, Englewood, CO (US)

(72) Inventors: Wayne J. Powell, Centennial, CO (US); Robert D. Boehmer, Centennial, CO (US)

(73) Assignee: Colorado Energy Research Technologies, LLC, Englewood, CO (US)

( * ) Notice: Subject to any disclaimer, the term of this patent is extended or adjusted under 35 U.S.C. 154(b) by 0 days.

(21) Appl. No.: 14/477,789

(22) Filed: Sep. 4, 2014

(51) Int. Cl.
*H05B 37/02* (2006.01)
*H05B 33/08* (2006.01)

(52) U.S. Cl.
CPC ..... *H05B 33/0815* (2013.01)

(58) Field of Classification Search
CPC . H05B 33/08; H05B 33/0803; H05B 33/0896
USPC ..... 315/185 R, 227 R, 276, 291, 299
See application file for complete search history.

(56) References Cited

U.S. PATENT DOCUMENTS

| | | | | |
|---|---|---|---|---|
| 6,856,103 | B1 * | 2/2005 | Hudson et al. | 315/299 |
| 7,053,557 | B2 | 5/2006 | Cross et al. | |
| 7,067,992 | B2 | 6/2006 | Leong et al. | |
| 7,350,936 | B2 | 4/2008 | Ducharme et al. | |
| 8,115,411 | B2 | 2/2012 | Shan | |
| 8,330,381 | B2 | 12/2012 | Langovsky | |
| 8,400,081 | B2 | 3/2013 | Catalano et al. | |
| 8,502,454 | B2 * | 8/2013 | Sadwick | 315/51 |
| 8,575,856 | B2 * | 11/2013 | Chung et al. | 315/291 |
| 8,841,856 | B1 * | 9/2014 | Beasley | 315/253 |
| 2008/0290814 | A1 | 11/2008 | Leong et al. | |
| 2010/0033095 | A1 | 2/2010 | Sadwick | |
| 2010/0148673 | A1 | 6/2010 | Stewart et al. | |
| 2012/0068604 | A1 | 3/2012 | Hasnain et al. | |
| 2012/0161666 | A1 | 6/2012 | Antony et al. | |
| 2012/0181952 | A1 * | 7/2012 | Roeer | 315/307 |
| 2012/0286683 | A1 * | 11/2012 | Radermacher | 315/201 |
| 2012/0293996 | A1 | 11/2012 | Thomas et al. | |

(Continued)

FOREIGN PATENT DOCUMENTS

| | | |
|---|---|---|
| JP | 2014103261 | 6/2014 |
| WO | 2010/047433 | 4/2010 |

(Continued)

OTHER PUBLICATIONS

"LED Ballasts" Atmel, screen capture Oct. 2014, http://www.atmel.com/applications/lighting/led_ballasts/default.aspx.

*Primary Examiner* — Thuy Vinh Tran
(74) *Attorney, Agent, or Firm* — Fish & Tsang LLP

(57) ABSTRACT

A system and method for converting alternating current from at least two types of electronic ballasts for fluorescent bulbs into direct current for an array of LEDs. The device is assembled such that it can fit into existing fluorescent bulb fixtures. Alternating current from a contemplated electronic ballast can have one of two peak-to-peak voltages and the circuitry of the device will convert either alternating current into approximately the same direct current. In doing so, the array of LEDs is illuminated providing an LED alternative to fluorescent light bulbs.

14 Claims, 2 Drawing Sheets

(56) References Cited

U.S. PATENT DOCUMENTS

| | | | | |
|---|---|---|---|---|
| 2012/0306403 | A1* | 12/2012 | Chung et al. | 315/291 |
| 2013/0038230 | A1 | 2/2013 | Brown et al. | |
| 2013/0320869 | A1 | 12/2013 | Jans et al. | |

FOREIGN PATENT DOCUMENTS

| | | |
|---|---|---|
| WO | 2012/068687 | 5/2012 |
| WO | 2013024389 | 2/2013 |

* cited by examiner

SYSTEMS AND METHODS FOR CONVERTING ALTERNATING CURRENT TO DRIVE LIGHT-EMITTING DIODES

FIELD OF THE INVENTION

The field of the invention is lighting systems, in particular, lighting systems that use existing fluorescent light ballasts to drive light-emitting diodes (LED) arrays.

BACKGROUND

The following description includes information that may be useful in understanding the present invention. It is not an admission that any of the information provided herein is prior art or relevant to the presently claimed invention, or that any publication specifically or implicitly referenced is prior art.

Lighting, whether indoor or outdoor facilities, is one of the largest energy consumers in developed countries and is typically extremely inefficient. The U.S. Energy Information Administration (ETA) estimates that in 2010 about 499 billion kilowatt-hours (kWh) of electricity were used for lighting by the residential and commercial sectors. This was equal to about 18% of the total electricity consumed by both of those sectors and about 13% of total U.S. electricity consumption. The efficiency of lighting varies by the particular type of lighting technology. Incandescent lighting is approximately 10% efficient, fluorescent lighting is approximately 50% efficient, and light-emitting diode (LED) lighting is approximately 80% efficient. These energy losses are generally attributable to heat generation. Thus, for an incandescent light, nearly 90% of the energy used is lost in the form of heat while only 10% of the energy is converted to light. A 100 watt light will produce 90 watts of heat. Heat in turn can cause a secondary effect on efficiency through the additional need for air conditioning.

Significant efforts are being made to reduce these energy losses. For example, incandescent lamps are being phased out by federal law. The most common form of lighting for commercial and industrial uses is the fluorescent lamp. All fluorescent lights require a ballast circuit to provide the necessary electric energy to "start" the light and keep it running. The visible light produced by a fluorescent light is a 2 step process. First, the mercury in the light must be ionized to produce photons. This is the first step in lighting a fluorescent light. But the high energy photons produced from the mercury ionization is not in the visible spectrum. These photons are converted to visible light when they strike the phosphor material coated on the inner surface of the light which in turn emits photons in the visible spectrum. Once the mercury has ionized, the light can be run in a lower energy state. It is the function of the ballast circuit to control these two steps. Depending on the ballast type, it may also need to be able to detect whether there is a functioning fluorescent light present.

Early ballasts, referred to as magnetic ballasts, consisted of a magnetic circuit that used a starter circuit to initialize mercury ionization. However, this type of ballast is inefficient and in 2010 federal law prohibited the sale of or installation of magnetic ballasts. A new more efficient ballast design emerged in the 1990s: the electronic ballast. It was able to improve efficiency by operating at significantly higher frequencies (50 kHz verses the 50-60 Hz of magnetic ballasts). Electronic ballasts are the type currently in use and, although they increase the efficiency of fluorescent lights by 15%-20% (http://ateam.lbl.gov/DesignGuide/DGHtm/electronicvs-.magneticballasts.htm), fluorescent lamps still are not nearly as efficient as LED lights. LED lights can be arranged to fit into devices or housings that have the same form factor as fluorescent lights, but, since LED lights require direct current instead of alternating current, LED lights cannot directly replace fluorescent bulbs without first converting and modifying an AC signal from a ballast.

Efforts have been made to develop devices to replace fluorescent lights with LED lights. For example, U.S. Patent Application No. 2010/0148673 to Stewart et al. teaches an LED lighting device that connects to an existing G23-type fluorescent lighting connector. In Stewart, AC power is converted to DC power, which is supplied to a pulse width modulation (PWM) controller to generate a signal pulse. The signal pulse creates the drive voltage for LEDs. Pulse-width modulation is necessary in the Stewart et al. application to regulate current sent to the LED array. Stewart et al. further discloses that the current through the LEDs is controlled by an LED current controller. A comparator detects voltage drops as current flow through the LEDs, and provides feedback to the LED current controller, thus enabling regulation of power to the LEDs. This system fails to appreciate the advantage of receiving input from different types of ballast, and it also fails to appreciate that voltage and current can be effectively regulated without the use of pulse-width modulation with feedback control.

U.S. Pat. No. 8,330,381 to Langovsky teaches a system of driving an LED array using an output from ballasts typically used to power fluorescent bulbs. To power the LED array this system incorporates, among other things, a pulse-width modulator and a current sensor. However, this system fails to appreciate that an LED driving circuit created without a pulse-width modulator or current sensor can produce desirable results while being made far less expensively. In addition, the current sensor of Langovsky is used to provide feedback to the pulse-width modulator such that the pulse-width modulator can control the amount of current sent to the LED array. Ultimately, Langovsky fails to appreciate the advantages of a system that uses only passive components without implementing any kind of feedback loop to regulate current sent to the LEDs.

U.S. Patent Application No. 2012/0068604 Hasnain et al. teaches a system of powering LEDs that are adapted to fit into existing fluorescent tube lighting sockets. To convert AC signal from a ballast to a DC signal useable by an LED array, the system has implemented a power adapter where the power adapter used in the system depends on what type of ballast it is to be used with. This system fails to appreciate advantages associated with a system that can seamlessly receive input from more than one type of ballast without needing a customized power adapter for each.

U.S. Pat. No. 8,115,411 to Shan teaches an LED lighting system having a voltage feedback constant current power supply circuitry and high power LEDs. Systems of Shan use a pulse-width modulator to control DC current supplied to the LEDs. A voltage sensor receives information from the LEDs and provides feedback to the current control circuit, which can change the current supply to the LEDs via the PWM. Shan, however, requires removal or bypassing of any ballast that may be in place in the existing fixture. As a result, Shan fails to contemplate a system that is compatible with at least two different types of ballasts.

In addition to the above-described patent documents, the following also make efforst to provide solutions to the same issue of replacing a fluorescent light with an LED light: U.S. Patent Application No. 2010/0033095 to Sadwick, U.S. Pat. No. 7,053,557 to Cross et al., U.S. Pat. No. 7,067,992 to Leong et al., U.S. Pat. No. 8,400,081 to Catalano et al. However, none of the references discussed above appreciates that a system for replacing fluorescent lights with LED lights can operate using only passive circuit components, thus creating the need for an improved LED driving lighting device.

All publications herein are incorporated by reference to the same extent as if each individual publication or patent application were specifically and individually indicated to be incorporated by reference. Where a definition or use of a term in an incorporated reference is inconsistent or contrary to the definition of that term provided herein, the definition of that term provided herein applies and the definition of that term in the reference does not apply.

SUMMARY OF THE INVENTION

The inventive subject matter provides a lighting system that enables a conventional alternating current ballast, that is under normal operation for driving a fluorescent light tube, to drive an array of LEDs. There are at least two different types of conventional electronic ballasts in the market (e.g., rapid start and instant start ballasts). Each type of conventional ballast generates alternating current with a different peak-to-peak voltage for driving fluorescent lights. However LEDs require at least a specified amount of voltage and direct current both of which are specified by the manufacturer of the LEDs. Thus, in one aspect of the invention, the lighting system detects the peak-to-peak voltage of the alternating current generated by the conventional ballast and converts the alternating current to a direct current having the proper voltage specified by the LED manufacture to drive the array of LEDs.

In some embodiments, the lighting system achieves this objective by providing a conversion circuit to couple the ballast to the array of LEDs (i.e., it can be placed between ballast and the LED arrays). The conversion circuit of some embodiments includes multiple circuitries, that when working together, can convert alternating current from either a rapid start electronic ballast or an instant start electronic ballast to a direct current having the proper voltage and current as specified by the LED manufacture for driving the array of LEDs.

In another aspect of the invention, lighting device with a built-in conversion circuit as well as an array of LEDs is presented. One of the advantages of using the conversion circuit is that one can easily replace fluorescent light tubes with more energy efficient LED arrays without modifying or replacing existing ballasts. The conversion circuit and/or the lighting device with the built-in conversion circuit provide a plug-and-play mechanism to replace fluorescent tubes with LED lighting arrays.

In preferred embodiments, the conversion circuit includes LED driving circuitry to convert an alternating current having a comparatively low peak-to-peak voltage (e.g., approximately 1 kVpp) into a direct current, LED driving circuitry to convert an alternating circuit having a comparatively high peak-to-peak voltage (e.g., 2 kVpp) into a direct current, and switching circuitry configured to switch an input alternating current between the LED driving circuitries, based on a peak-to-peak voltage of the input alternating current.

As such, the switching circuitry is configured to couple to an alternating current power source, such as an electronic ballast (e.g. a rapid start ballast or an instant start ballast). Each of the LED driving circuitries is coupled to both the switching circuitry and the array of LEDs. When the peak-to-peak voltage of the input alternating current exceeds a threshold value or range of values, then the switching circuitry switches the alternating current to one of the LED driving circuitries based on the peak-to-peak voltage of the input alternating current. Either LED driving circuitry can then convert the input alternating current to a direct current having a specific voltage and current to drive the array of LEDs.

Preferably, the switching circuit is configured to switch to the LED driving circuitry for comparatively high peak-to-peak voltage when the peak-to-peak voltage of the input alternating current is higher than approximately 1 kilovolt peak-to-peak (kVpp). More preferably, the switching circuit is configured to switch to the LED driving circuitry for comparatively high peak-to-peak voltage when the peak-to-peak voltage of the input alternating current is higher than approximately 1.2 kVpp. Even more preferably, the switching circuit is configured to switch to the second circuitry when the peak-to-peak voltage of the input alternating current is higher than 1.5 kVpp. Yet even more preferably, the switching circuit is configured to switch to the second circuitry when the peak-to-peak voltage of the input alternating current is approximately than 2 kVpp.

The switching circuitry can be implemented using any appropriate type of switch. For example, the switching circuitry of some embodiments can be implemented using a set of metal-oxide-semiconductor field-effect transistor (MOSFET) switches, a set of triode for alternating current (TRIAC) switches, a set of relay switches (e.g., a set of solid state relays, etc.), or any combination thereof.

In some embodiments, the LED driving circuitry for comparatively low peak-to-peak voltage includes a set of capacitors and at least one full-wave rectifier (e.g., a diode bridge rectifier). The set of capacitors is configured to convert the alternating current from a comparatively low peak-to-peak voltage (e.g., 1 kVpp) to a reduced peak-to-peak voltage, and the full-wave rectifier is configured to then convert the reduced peak-to-peak voltage alternating current to a direct current to drive the array of LEDs.

In some embodiments, the LED driving circuitry for comparatively high peak-to-peak voltage also includes a set of capacitors. The set of capacitors in the LED driving circuitry for comparatively high peak-to-peak voltage is configured to reduce the peak-to-peak voltage of the comparatively high peak-to-peak alternating current to a reduced peak-to-peak voltage alternating current. In some embodiments, the set of capacitors in the LED driving circuitry for comparatively high peak-to-peak voltage can overlap with the set of capacitors in the LED driving circuitry for comparatively low peak-to-peak voltage (i.e., capacitors of the LED driving circuitry for comparatively low peak-to-peak voltage are also a part of the LED driving circuitry for comparatively high peak-to-peak voltage). In other embodiments, the LED driving circuitry for comparatively low peak-to-peak voltage and LED driving circuitry for comparatively high peak-to-peak voltage do not share capacitors, and in still further embodiments, neither LED driving circuitry shares any circuit components with the other.

After one of the LED driving circuitries reduces the voltage of an alternating current from an electronic ballast, a full-wave rectifier converts the alternating current with the reduced voltage to a direct current for driving the array of LEDs. In some embodiments the full-wave rectifier is a diode bridge, though other full-wave rectifiers can be used to achieve the same result (e.g., a center tapped transformer rectifier). Ultimately, the reduced voltage direct current is sufficient to drive an LED or LED array, and thus the voltage and current of the reduced voltage direct current are determined by the manufacturer's specification for the LED or LED array, the number of LEDs in the array, and the configuration of the LEDs (i.e., whether in parallel or in series with one another).

In another aspect of the invention, a method implementing the system described above is provided. The method includes the step of switching, by a switching circuitry, an alternating current received from the conventional alternating current ballast between an LED driving circuitry for comparatively high peak-to-peak voltage and an LED driving circuitry for comparatively low peak-to-peak voltage based on a peak-to-peak voltage of the alternating current. The method also includes the step of converting, by the LED driving circuitry, the alternating current having either a comparatively high or comparatively low peak-to-peak voltage into a direct current based on the required voltage and/or current specified by the LED manufacturer, the number of LEDs, and the configuration of LEDs in the array of LEDs.

Various objects, features, aspects and advantages of the inventive subject matter will become more apparent from the following detailed description of preferred embodiments, along with the accompanying drawing figures in which like numerals represent like components.

DETAILED DESCRIPTION

Figure 1:
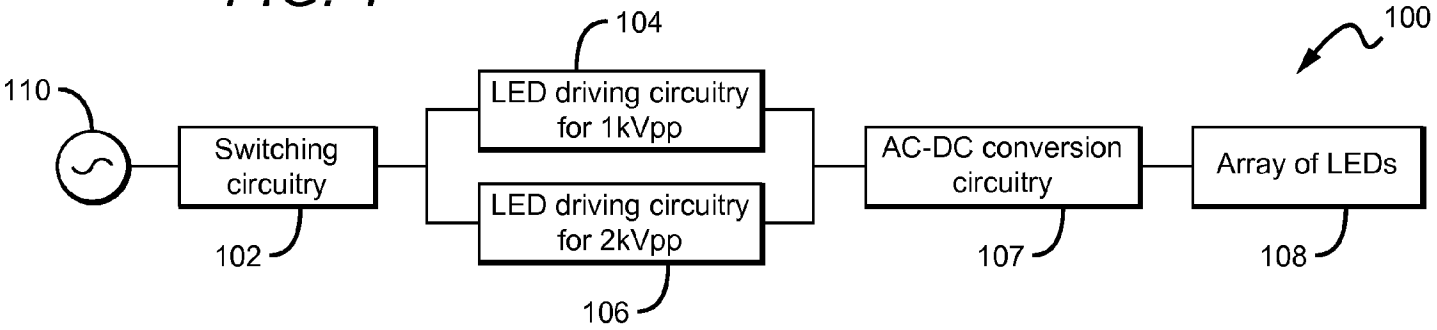
FIG. 1 shows a block diagram of a preferred embodiment.

It should be noted that any language directed to a computer should be read to include any suitable combination of computing devices, including servers, interfaces, systems, databases, agents, peers, engines, controllers, or other types of computing devices operating individually or collectively. One should appreciate the computing devices comprise a processor configured to execute software instructions stored on a tangible, non-transitory computer readable storage medium (e.g., hard drive, solid state drive, RAM, flash, ROM, etc.). The software instructions preferably configure the computing device to provide the roles, responsibilities, or other functionality as discussed below with respect to the disclosed apparatus. In especially preferred embodiments, the various servers, systems, databases, or interfaces exchange data using standardized protocols or algorithms, possibly based on HTTP, HTTPS, AES, public-private key exchanges, web service APIs, known financial transaction protocols, or other electronic information exchanging methods. Data exchanges preferably are conducted over a packet-switched network, the Internet, LAN, WAN, VPN, or other type of packet switched network.

The following discussion provides many example embodiments of the inventive subject matter. Although each embodiment represents a single combination of inventive elements, the inventive subject matter is considered to include all possible combinations of the disclosed elements. Thus if one embodiment comprises elements A, B, and C, and a second embodiment comprises elements B and D, then the inventive subject matter is also considered to include other remaining combinations of A, B, C, or D, even if not explicitly disclosed.

As used herein, and unless the context dictates otherwise, the term "coupled to" is intended to include both direct coupling (in which two elements that are coupled to each other contact each other) and indirect coupling (in which at least one additional element is located between the two elements). Therefore, the terms "coupled to" and "coupled with" are used synonymously.

In some embodiments, the numbers expressing quantities of ingredients, properties such as concentration, reaction conditions, and so forth, used to describe and claim certain embodiments of the invention are to be understood as being modified in some instances by the term "about." Accordingly, in some embodiments, the numerical parameters set forth in the written description and attached claims are approximations that can vary depending upon the desired properties sought to be obtained by a particular embodiment. In some embodiments, the numerical parameters should be construed in light of the number of reported significant digits and by applying ordinary rounding techniques. Notwithstanding that the numerical ranges and parameters setting forth the broad scope of some embodiments of the invention are approximations, the numerical values set forth in the specific examples are reported as precisely as practicable. The numerical values presented in some embodiments of the invention may contain certain errors necessarily resulting from the standard deviation found in their respective testing measurements.

Unless the context dictates the contrary, all ranges set forth herein should be interpreted as being inclusive of their endpoints and open-ended ranges should be interpreted to include only commercially practical values. Similarly, all lists of values should be considered as inclusive of intermediate values unless the context indicates the contrary.

As used in the description herein and throughout the claims that follow, the meaning of "a," "an," and "the" includes plural reference unless the context clearly dictates otherwise. Also, as used in the description herein, the meaning of "in" includes "in" and "on" unless the context clearly dictates otherwise.

The recitation of ranges of values herein is merely intended to serve as a shorthand method of referring individually to each separate value falling within the range. Unless otherwise indicated herein, each individual value is incorporated into the specification as if it were individually recited herein. All methods described herein can be performed in any suitable order unless otherwise indicated herein or otherwise clearly contradicted by context. The use of any and all examples, or exemplary language (e.g. "such as") provided with respect to certain embodiments herein is intended merely to better illuminate the invention and does not pose a limitation on the scope of the invention otherwise claimed. No language in the specification should be construed as indicating any non-claimed element essential to the practice of the invention.

Groupings of alternative elements or embodiments of the invention disclosed herein are not to be construed as limitations. Each group member can be referred to and claimed individually or in any combination with other members of the group or other elements found herein. One or more members of a group can be included in, or deleted from, a group for reasons of convenience and/or patentability. When any such inclusion or deletion occurs, the specification is herein deemed to contain the group as modified thus fulfilling the written description of all Markush groups used in the appended claims.

The inventive subject matter provides a lighting system that enables a conventional alternating current ballast, that under normal operation is for driving a fluorescent light tube, to drive an array of LEDs. There are at least two different types of conventional alternating current ballasts in the market for use with fluorescent light tubes (e.g., rapid start and instant start ballasts). Each type of conventional ballast generates alternating current with a different peak-to-peak voltage for driving fluorescent lights. However, unlike fluorescent light tubes, LEDs are powered by direct current where the direct current must have at least a specific voltage and/or current for the LED to operate. The specific voltage and/or current are often specified by the manufacturer of the LEDs. Thus, the lighting system in one aspect of the invention converts the alternating current to a direct current having the proper voltage and/or current specified by the LED manufacture to drive the array of LEDs based on the peak-to-peak voltage of an alternating current generated by the conventional ballast.

In some embodiments, the lighting system achieves this objective by providing a circuit configured to couple the alternating current ballast and the array of LEDs (i.e., go in between the ballast and the LED arrays). The conversion circuit of some embodiments includes multiple circuitries that can receive different types of alternating currents having different peak-to-peak voltages and convert the alternating currents to a direct current having the proper voltage and/or current for driving the array of LEDs based on the manufacturer's specification.

FIG. 1 illustrates a schematic of an example conversion circuit 100. The conversion circuit 100 includes a switching circuitry 102, an LED driving circuitry 104, an LED driving circuitry 106, and an AC-DC conversion circuitry 107. The switching circuitry 102 is coupled with a power source 110. Preferably, the power source 110 supplies an alternating current (e.g., electronic ballast, such as a rapid start or instant start ballast). The switching circuitry 102 is also coupled to both LED driving circuitries 104 and 106.

The LED driving circuitry 104 and AC-DC conversion circuitry 107 are configured to drive the array of LEDs 108. To do so, the LED driving circuitry 104 reduces the peak-to-peak voltage of an alternating current having a comparatively low peak-to-peak voltage (e.g., approximately 1 kVpp) to an alternating current having a reduced peak-to-peak voltage, and then the AC-DC conversion circuitry converts the reduced peak-to-peak voltage alternating current to a direct current sufficient to provide power to the array of LEDs 108 according to the specification of the LED manufacturer (e.g., 1.8-3.3 volts across each LED, depending on the color of the LED and the manufacturer's specification, and approximately 20 mA-50 mA, 50-100 mA, 100-150 mA, 150-200 mA, 200-250 mA, 250-300 mA, and 300-350 mA through each LED depending on the manufacturer's specification).

The LED driving circuitry 106 and AC-DC conversion circuitry 107 are also configured to drive the array of LEDs 108. To do so, the LED driving circuitry 106 reduces the peak-to-peak voltage of an alternative current having a comparatively high peak-to-peak voltage (e.g., approximately 2 kVpp) to an alternating current having a reduced peak-to-peak voltage, and then the AC-DC conversion circuitry 107 converts the reduced peak-to-peak voltage alternating current to a direct current having a current and voltage value based on the specification of the LED's manufacturer (e.g., substantially the same direct current produced by the LED driving circuit 104). In other words, the LED driving circuitry 106 is configured to take in an alternating current having a higher peak-to-peak voltage than what the LED driving circuitry 104 is configured to receive. Preferably, the peak-to-peak voltage that the LED driving circuitry 106 is configured to receive is approximately double than what the LED driving circuitry 104 is configured to receive.

Both the LED driving circuitry 104 and LED driving circuitry 106 are configured to generate reduced peak-to-peak voltage alternating currents having approximately the same peak-to-peak voltage before the AC-DC conversion circuitry 107 converts the alternating currents having reduced peak-to-peak voltages into a direct current. In some embodiments, the AC-DC conversion circuitry is configured to convert the reduced peak-to-peak voltage alternating current to a direct current having a voltage and/or current that is based on the LED manufacturer's specification for the LEDs and based on the configuration of the array of LEDs.

Different embodiments implement the LED driving circuitries 104 and 106 in different ways. In some embodiments, each of the LED driving circuitries 104 and 106 comprises one or more capacitors that are used to reduce the peak-to-peak voltage of the received alternating current. For the LED driving circuitry 106 to be able to reduce the peak-to-peak voltage of an alternating current having more (e.g., double) the peak-to-peak voltage than that of the LED driving circuitry 104, the capacitors of the LED driving circuitry 106 of some embodiments have higher resulting capacitance than the capacitors of the LED driving circuitry 104. In some embodiments, the LED driving circuitry 104 and the LED driving circuitry 106 share some of the capacitors in the overall conversion circuit 100 such that some or all capacitors found in the LED driving circuitry 104 are part of the LED driving circuitry 106. In other embodiments, the LED driving circuitry 104 and 106 do not share any capacitors.

In addition, each of the LED driving circuitries 104 and 106 comprises a full-wave rectifier. Again, in some embodiments, each of the LED driving circuitries 104 and 106 can includes its own full-wave rectifier. In other embodiments, the LED driving circuitries 104 and 106 can share one or more full-wave rectifier within the overall conversion circuit 100. Full wave rectifiers can be configured in many different ways including a diode bridge, though any other rectifier known in the art can similarly be implemented without deviating from the inventive aspects described herein (e.g. a center tapped transformer rectifier).

As mentioned above, there are different types of electronic ballasts that provide alternating current having different peak-to-peak voltages. For example, a rapid start ballast provides alternating current having approximately 2 kVpp, while an instant start ballast provides alternating current having approximately 1 kVpp. As used herein, approximately in this context is defined to be within +/−15% of a described value.

As such, the conversion circuit 100 of some embodiments also includes switching circuitry 102 configured to switch between the LED driving circuitries 104 and 106 based on the peak-to-peak voltage of the alternating current received from the power source 110. In other words, the switching circuitry 102 will direct the alternating current to either the LED driving circuitry 104 or the LED driving circuitry 106 based on the peak-to-peak voltage of the alternating current from the power source 110. In embodiments where the LED driving circuitry 104 and the LED driving circuitry 106 share components, the switching circuitry is configured to direct the alternating current to either the LED driving circuitry 104 (e.g., when the peak-to-peak voltage of the alternating current from the power source is approximately 1 kVpp), or to the LED driving circuitry 106 that includes some of the components from the LED driving circuitry 104 (e.g., when the peak-to-peak voltage of the alternating current from the power source is approximately 2 kVpp).

Figure 2:
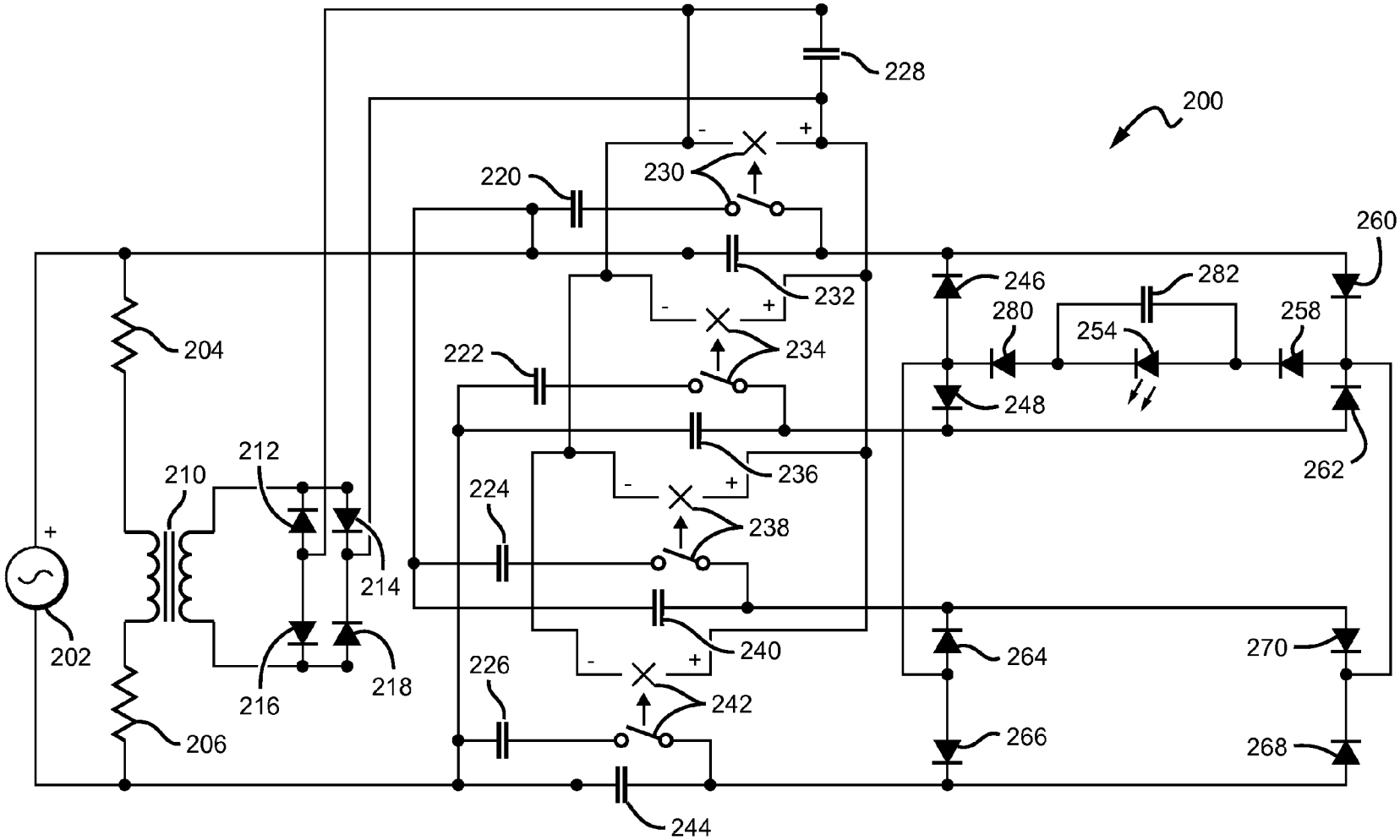
FIG. 2 is a circuit diagram of a preferred embodiment.

FIG. 2 shows a circuit diagram of an example conversion circuit 200 according to the inventive subject matter discussed above by reference to FIG. 1. The circuit 200 can be used to enable at least two types of ballasts (e.g., a rapid start ballast and an instant start ballast) to drive an array of LEDs 254. Similar to the conversion circuit 100 of FIG. 1, the conversion circuit 200 also has a switching circuitry and an LED driving circuitry that, along with an AC-DC conversion circuitry, converts an alternating current with comparatively low peak-to-peak voltage (e.g., approximately 1 kVpp) to a direct current to drive the array of LEDs 254, and an LED driving circuitry that, along with an AC-DC conversion circuitry, converts an alternating current with comparatively high peak-to-peak voltage (e.g., approximately 2 kVpp) to a direct current to drive an array of LEDs.

In this conversion circuit 200, the switching circuitry includes a transformer 210, diodes 212, 214, 216, and 218, a capacitor 228, and switches 230, 234, 238, and 242. The switching circuitry is configured to receive an alternating current from power source 202, and to then activate switches 230, 234, 238, and 242 if the peak-to-peak voltage of the alternating current received from the power source 202 exceeds a specific threshold (e.g., preferably greater than 1 kVpp, more preferably greater than 1.1 kVpp, even more preferably greater than 1.2 kVpp, even more preferably greater than 1.5 kVpp).

The transformer 210 is configured to reduce (or, in some embodiments, increase) the peak-to-peak voltage of the incoming alternating current based on the specification of the switches being used in the conversion circuit 200 (i.e., the threshold voltage needed to activate the switches) and the diodes 212, 214, 216, and 218 are configured to rectify the reduced (or increased) alternating current to produce a direct current to activate or deactivate the switches 230, 234, 238, and 242. For example, if the incoming alternating current has a peak-to-peak voltage of approximately 1 kVpp, the transformer 210 and diodes 212, 214, 216, and 218 can work together to produce a resulting direct current signal that is insufficient to activate the switches 230, 234, 238, and 242 (i.e., the resulting direct current has a voltage below the threshold voltage needed to activate the switches 230, 234, 238, and 242). However, if the incoming alternating current has a peak-to-peak voltage of approximately 2 kVpp, the transformer 210 and diodes 212, 214, 216, and 218 can work together to produce a resulting direct current signal that is sufficient to activate the switches 230, 234, 238, and 242. After passing through the transformer, the alternating current is rectified using diodes 212, 214, 216, and 218 (i.e., the resulting direct current has a voltage at or above the threshold voltage needed to activate the switches 230, 234, 238, 242).

In some embodiments, the switching circuitry also includes a capacitor 228, which is configured to smooth the direct current signal coming from the rectifier (e.g., diodes 212, 214, 216, and 218), thereby making the resulting direct current compatible with the switches 230, 234, 238, 242. Ultimately, the switching circuitry of the conversion circuit 200 provides switching such that the LED driving circuitry for the low peak-to-peak voltage is activated only when the alternating current received from the power source 202 has a comparatively low peak-to-peak voltage (e.g., approximately 1 kVpp) and the LED driving circuitry for the high peak-to-peak voltage is activated only when the alternating current received from the power source 202 has a comparatively high peak-to-peak voltage (e.g., approximately 2 kVpp).

In this conversion circuit 200 as shown in FIG. 2, the LED driving circuitry for the low peak-to-peak voltage includes capacitors 232, 236, 240, and 244 and the AC-DC conversion circuitry includes diodes 246, 248, 260, 262, 258, 280, 264, 266, 268, and 270 along with capacitor 282. In some embodiments, the LED driving circuitry for the low peak-to-peak voltage and the AC-DC conversion circuitry are configured to convert an alternating current having a peak-to-peak voltage of approximately 1 kVpp into a direct current usable by the array of LEDs 254. To do so, the LED driving circuitry for the low peak-to-peak voltage includes capacitors (e.g., capacitors 232, 236, 240 and 244 as shown in this figure) that each has a capacitance (e.g., approximately 200 pF, 250 pF, 300 pF, 350 pF, and 400 pF and all ranges therein, such as 200-250 pF, 250-300 pF, 300-350 pF, and 350-400 pF) selected to produce a reduced peak-to-peak alternating current signal according to manufacturer's specifications, the number of LEDs, and the configuration of the LEDs in the LED array 254.

It is contemplated that each individual capacitor can also be expressed as a group of capacitors or other components arranged to produce approximately the same desired capacitance. Once the peak-to-peak voltage of the alternating current has been reduced from 1 kVpp, diodes 246, 248, 260, 262, 258, 280, 264, 266, 268 and 270 of the AC-DC conversion circuitry collectively rectify the alternating current to a direct current with a voltage sufficient to drive the LED array 254 according to manufacturer's specifications, the number of LEDs, and the configuration of the LEDs in the LED array 254.

Typically, after the AC-DC conversion circuitry converts the signal from alternating current to direct current via a full-wave rectifier the signal is not smooth. Since LEDs require a consistent power source that does not fluctuate, the AC-DC conversion circuitry includes a capacitor 282 placed in parallel with the array of LEDs 254 to smooth out the direct current before feeding it to the LED array 254. This ensures the direct current passed through the array of LEDs 254 meets the manufacturer's required specifications in terms of current and voltage.

Similar to the LED driving circuitry for the low peak-to-peak voltage, the LED driving circuitry for the high peak-to-peak voltage includes numerous capacitors and diodes. As mentioned above, the LED driving circuitry for the comparatively high peak-to-peak voltage of some embodiments can include some or all components of the LED driving circuitry for the comparatively low peak-to-peak voltage in order to reduce redundancy. Specifically, the LED driving circuitry for the high peak-to-peak voltage includes capacitors 220, 222, 224, and 226 in addition to capacitors 232, 236, 240, and 244 that are part of the LED driving circuitry for the comparatively low peak-to-peak voltage. The new capacitors 220, 222, 224, and 226 are placed in parallel to capacitors 232, 236, 240, and 244, respectively, to create a higher resultant capacitance for the LED driving circuitry for the high peak-to-peak voltage. The higher resultant capacitance allows the LED driving circuitry for the comparatively high peak-to-peak voltage with the AC-DC conversion circuitry to generate substantially the same direct current as generated by the LED driving circuitry for the comparatively low peak-to-peak voltage with the AC-DC conversion circuitry, even when the alternating current received by the LED driving circuitry for the comparatively high peak-to-peak voltage is approximately double that of the LED driving circuitry for the comparatively low peak-to-peak voltage.

The AC-DC conversion circuitry includes diodes 246, 248, 260, 262, 258, 280, 264, 266, 268, and 270. The diodes 246, 248, 260, 262, 258, 280, 264, 266, 268, and 270 collectively rectify an alternating current from either of the LED driving circuitries to a direct current with a voltage sufficient to drive the LED array 254 according to a manufacturer's specifications, the number of LEDs, and the configuration of the LEDs in the LED array 254. The AC-DC conversion circuitry for the comparatively high peak-to-peak voltage of some embodiments also includes the capacitor 282 to smooth out the direct current before feeding it to the LED array 254.

Thus, under this arrangement of circuitry components, when the switches of the switching circuitry are not activated, the switching circuitry causes the alternating current to first encounter capacitors 232, 236, 240, and 244 of the LED driving circuitry for comparatively low peak-to-peak voltage.

After the LED driving circuitry for comparatively low peak-to-peak voltage drops the peak-to-peak voltage of the alternating current, the signal encounters diodes 246, 248, 260, 262, 258, 280, 264, 266, 268, and 270 and capacitor 282 of the AC-DC conversion circuitry which produce a rectified and smoothed direct current. However, when the switches are activated (e.g. when the peak-to-peak voltage of the power source is above, for example, 1.2 kVpp), the switching circuitry causes the alternating current to encounter capacitors 220, 222, 224, 226, 232, 236, 240, and 244 of the LED driving circuitry for comparatively high peak-to-peak voltage, and diodes 246, 248, 260, 262, 258, 280, 264, 266, 268, and 270 and capacitor 282 of the AC-DC conversion circuitry.

The array of LEDs 254 can be configured in a number of different ways. In the conversion circuit 200 of FIG. 2, the array of LEDs is modeled as a single LED though it is contemplated the array can be configured as a number of LEDs in series with each other. It can also be configured as two sets of LEDs in parallel with each other, where each set includes numerous LEDs (e.g., 25, 30, 40, 45, or 50) configured in series with one another. Including more or fewer LEDs has an effect on the power requirements of the system, which in turn affects the required capacitances for the capacitors 220, 232, 222, 236, 224, 240, 226, 244 of the LED driving circuitries.

Figure 3:
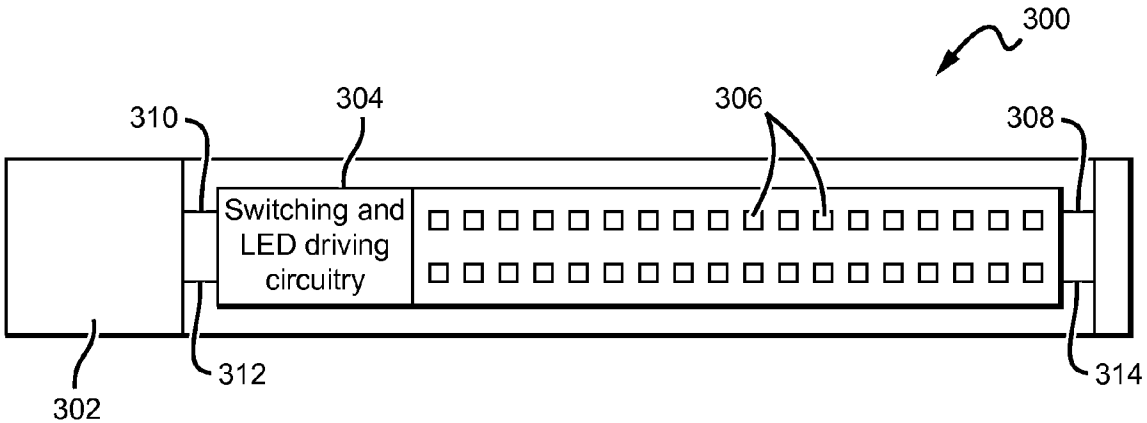
FIG. 3 shows the system as a single unit and plugged into existing fluorescent tube lighting device.

FIG. 3 shows an example lighting device 300 that can be directly plugged into existing fluorescent lighting fixtures with different types (e.g., rapid start, instant start, etc.) of electronic ballasts (e.g., ballast 302). The lighting device 300 includes conversion circuit 304 that can be implemented according to conversion circuits 100 and 200 of FIGS. 1 and 2, and an array of LEDs is shown with representative LEDs 306. Although the lighting device 300 is shown to include thirty-six LEDs, in different embodiments, different numbers of LEDs can be used (e.g., 10, 15, 20, 25, 30, 35, 40, 45, 50, 55, 60, 65, 70, 75, 80, 85, 90, 10-20, 20-30, 30-40, 40-50, 50-60, 60-70, 70-80, or 80-90). Additionally, in some embodiments, only one row of LEDs exists. LEDs 306 can be spaced out more or less depending on the lighting requirements (e.g., 0.2 inches, 0.4 inches, 0.6 inches, 0.8 inches, 1 inch, 1.2 inches, 1.4 inches, or 1.6 inches apart).

On the ends of the lighting device 300 are prongs 310, 312, 308, 314 similar to those found on standard fluorescent bulbs. This allows the system to snap into existing fluorescent sockets without any need for an adapter. In some embodiments, prongs 310 and 312 are connected to the ballast 302 such that an alternating current from the ballast can pass to the system. Alternating current from the ballast 302 can be received by pin 310 and/or 312 depending on the configuration of the lighting system and its associated circuitries. After receiving an alternating current from pin 310 and/or pin 312, the conversion circuit 304 converts the alternating current to a form (i.e., a direct current with sufficient voltage to drive the LEDs 306 according to the manufacturer of the LEDs) that is usable by the array of LEDs. The remaining prongs 308 and 314 can configured to complete the circuit via the light fixture to the ballast, or to provide power to a different LED lighting system that is connected in series with LED lighting system (e.g., it allows signal from the ballast to pass through to another LED lighting system). Prongs 308 and 314 can also exist for support and socket compatibility only (i.e., the circuit is completely contained within the system and requires only prongs 310 and 312).

It should be apparent to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Where the specification claims refers to at least one of something selected from the group consisting of A, B, C . . . and N, the text should be interpreted as requiring only one element from the group, not A plus N, or B plus N, etc.

What is claimed is:

1. A light-emitting diode (LED) lighting system for driving an array of LEDs using an electronic ballast supplying alternating current, wherein the array of LEDs have a manufacturer's specification of a current value and a voltage value required for activating the array of LEDs, comprising:

a first circuitry coupled to the array of LEDs and configured to convert an alternating current having a first peak-to-peak voltage into a first direct current and further configured to feed the first direct current into the array of LEDs, wherein the first circuitry comprises: (1) a first set of capacitors configured to convert the alternating current having the first peak-to-peak voltage to a modified alternating current having a reduced peak-to-peak voltage based on the manufacturer's specification for LEDs in the array of LEDs, and (2) at least one full-wave rectifier configured to convert the alternating current with the reduced peak-to-peak voltage to the first direct current;

a second circuitry coupled to the array of LEDs and configured to convert an alternating current having a second peak-to-peak voltage into a second direct current and further configured to feed the second direct current into the array of LEDs; and a switching circuitry configured to switch an input alternating current between the first circuitry and the second circuitry based on a peak-to-peak voltage of the input alternating current.

2. The light-emitting diode (LED) lighting system of claim 1, wherein the first peak-to-peak voltage is approximately 1 kilovolt.

3. The light-emitting diode (LED) lighting system of claim 1, wherein the second peak-to-peak voltage is approximately 2 kilovolts.

4. The light-emitting diode (LED) lighting system of claim 1, wherein the second circuitry comprises:

a second set of capacitors configured to convert the alternating current having the second peak-to-peak voltage to a modified alternating current having a reduced peak-to-peak voltage based on the manufacturer's specification for the LEDs in the array of LEDs; and at least one full-wave rectifier configured to convert the reduced alternating current to the second direct current.

5. The light-emitting diode (LED) lighting system of claim 4, wherein a resultant capacitance of the second set of capacitors is higher than a resultant capacitance of the first set of capacitors.

6. The light-emitting diode (LED) lighting system of claim 5, wherein the first set of capacitors makes up a subset of the second set of capacitors.

7. The light-emitting diode (LED) lighting system of claim 1, wherein the switching circuitry comprises a set of MOSFET switches.

8. The light-emitting diode (LED) lighting system of claim 1, wherein the switching circuitry comprises a set of TRIAC switches.

9. The light-emitting diode (LED) lighting system of claim 1, wherein the switching circuitry comprises a set of relay switches.

10. A method of driving an array of LEDs using a conventional alternating current ballast, wherein a manufacturer has specified a required voltage for activating the array of LEDs, the method comprising the steps of:

switching, by a switching circuitry, an alternating current received from the conventional alternating current ballast between a first circuitry and a second circuitry based on a peak-to-peak voltage of the alternating current;

when the alternating current has a first peak-to-peak voltage less than a threshold amount, converting, by the first circuitry, the alternating current having the first peak-to-peak voltage into a first direct current based on the required voltage specified by the manufacturer to feed into the array of LEDs; and when the alternating current has a second peak-to-peak voltage larger than the threshold amount, converting, by the second circuitry, the alternating current having the second peak-to-peak voltage into a second direct current based on the required voltage specified by the manufacturer to feed into the array of LEDs.

11. The method of claim 10, wherein converting the alternating current into the first direct current comprises:

reducing the first peak-to-peak voltage of the alternating current to a reduced peak-to-peak voltage; and converting the alternating current having the reduced peak-to-peak voltage to the first direct current based on a manufacturer's specification for the array of LEDs.

12. The method of claim 10, wherein converting the alternating current into the second direct current comprises:

reducing the second peak-to-peak voltage of the alternating current to a reduced peak-to-peak voltage; and converting the alternating current having the reduced peak-to-peak voltage to the first direct current based on a manufacturer's specification for the array of LEDs.

13. The method of claim 10, wherein the first peak-to-peak voltage is approximately 1 kilovolt.

14. The method of claim 10, wherein the second peak-to-peak voltage is approximately 2 kilovolts.

* * * * *